US008919082B1

(12) United States Patent
Cataldo

(10) Patent No.: US 8,919,082 B1
(45) Date of Patent: Dec. 30, 2014

(54) COLLAPSIBLE FOAM SHIPPING COOLER FOR PERISHABLES AND METHOD OF MAKING

(75) Inventor: Frank A. Cataldo, Des Moines, IA (US)

(73) Assignee: Iowa E. P. S. Products, Inc., Des Moines, IA (US)

( * ) Notice: Subject to any disclaimer, the term of this patent is extended or adjusted under 35 U.S.C. 154(b) by 736 days.

(21) Appl. No.: 12/484,755

(22) Filed: Jun. 15, 2009

(51) Int. Cl.
*B65D 81/38* (2006.01)
*B65B 43/08* (2006.01)
*B65D 43/08* (2006.01)

(52) U.S. Cl.
CPC ..... *B65D 81/3862* (2013.01); *B65D 43/08* (2013.01); *B65D 81/3816* (2013.01); *B65D 81/3851* (2013.01); *B65B 43/08* (2013.01); *Y10S 220/902* (2013.01)
USPC ..... 53/452; 53/456; 220/4.29; 220/592.25; 220/902

(58) Field of Classification Search
CPC ..... B65D 81/3862; B65D 81/3851; B65D 81/3816; F25D 23/063; F25D 3/06; Y10S 493/903
USPC ..... 53/456, 457, 452, 170, 173, 564, 566; 206/586, 594, 591, 523; 220/4.29, 220/592.25, 902; 493/903; 229/103.11
See application file for complete search history.

(56) References Cited

U.S. PATENT DOCUMENTS 2,240,256 A * 4/1941 Elmendorf ..... 428/98
3,222,697 A * 12/1965 Scheermesser ..... 428/160
3,240,845 A * 3/1966 Voelker ..... 220/902
3,251,382 A * 5/1966 Tatsch ..... 138/151
3,322,171 A * 5/1967 Cornell ..... 144/136.9
3,530,213 A * 9/1970 Belle Isle ..... 264/296
3,564,811 A * 2/1971 Freeman ..... 206/523
3,595,287 A * 7/1971 Indermark ..... 144/136.9
3,850,061 A * 11/1974 Wirstrom ..... 83/871
3,890,762 A * 6/1975 Ernst et al. ..... 53/440
3,980,005 A * 9/1976 Buonaiuto ..... 427/289
3,982,382 A * 9/1976 Vogel ..... 53/252
4,468,913 A * 9/1984 Guillon et al. ..... 53/440
4,642,970 A * 2/1987 Bane ..... 53/433
5,100,016 A * 3/1992 Wischusen, III ..... 229/103.11

(Continued)

FOREIGN PATENT DOCUMENTS

CA 2303574 A1 * 9/2001 ..... B65D 81/3862
FR 2079582 A5 * 11/1971 ..... B65D 81/3851

(Continued)

*Primary Examiner* — Stephen F Gerrity
(74) *Attorney, Agent, or Firm* — Brick Centry PC; Brian J. Laurenzo; Jessica L. Susie

(57) ABSTRACT

The present invention provides a collapsible foam shipping cooler and a process for producing the collapsible cooler. The collapsible cooler includes a linear series of attached side panel sections where each of the adjacent side panel sections are separated by a V groove formed by 45° beveled cuts made in a ends of each of the sections, and an adhesive tape flexible hinge is attached on the side of the panels opposite the V groove. The series of attached side panel sections is movable between a collapsed storage mode and an assembled mode where the series of sections are arranged to form a closed rectangular loop with top and bottom perimeter edges. Top and bottom foam panels contact the top and bottom edges of the closed loop to form a closed insulated cooler which is matingly received in a conventional corrugated box shipping container.

17 Claims, 4 Drawing Sheets

(56) References Cited

U.S. PATENT DOCUMENTS

| | | | | | |
|---|---|---|---|---|---|
| 5,102,004 | A | | 4/1992 | Hollander et al. | |
| 5,111,957 | A | | 5/1992 | Hollander et al. | |
| 5,215,248 | A | * | 6/1993 | Moser | 229/122.21 |
| 5,429,264 | A | | 7/1995 | Hollander et al. | |
| 5,441,170 | A | * | 8/1995 | Bane, III | 229/103.11 |
| 5,669,233 | A | * | 9/1997 | Cook et al. | 62/371 |
| 5,979,693 | A | * | 11/1999 | Bane, III | 220/592.2 |
| 6,067,779 | A | * | 5/2000 | Weder | 53/472 |
| 6,080,096 | A | | 6/2000 | Becker et al. | |
| 6,325,281 | B1 | * | 12/2001 | Grogan | 229/103.11 |
| 6,868,982 | B2 | | 3/2005 | Gordon | |
| 6,899,946 | B2 | * | 5/2005 | Geary et al. | 428/319.3 |
| 7,140,773 | B2 | | 11/2006 | Becker et al. | |
| 2003/0087051 | A1 | | 5/2003 | Murray | |

FOREIGN PATENT DOCUMENTS

| | | | | | |
|---|---|---|---|---|---|
| GB | 2081678 | A | * | 2/1982 | 206/523 |
| GB | 2451329 | A | * | 1/2009 | B65D 81/3862 |
| JP | 7-224942 | A | * | 8/1995 | F16J 15/10 |

* cited by examiner

COLLAPSIBLE FOAM SHIPPING COOLER FOR PERISHABLES AND METHOD OF MAKING

BACKGROUND OF THE INVENTION

1. Field of the Invention

The present invention relates to the field of insulated shipping containers, and more particularly to a process for producing a collapsible foam cooler.

2. Description of Related Art

Perishable products are commonly shipped to the consumer in insulated shipping containers to prevent spoilage in transit. Molded foam containers used in combination with an exterior corrugated shipping box are convenient to use and effective to protect perishables. However, molded containers require a substantial capital investment for molds, and each mold produces only one size of container. Also, empty molded containers consume a large amount of space for storage or shipping, thus resulting in high warehousing and shipping costs.

As can be seen by reference to the following U.S. Pat. Nos. 5,102,004; 5,111,957; 5,429,264; 6,080,096; 6,325,281; 6,868,982; 7,140,773 and U.S. Publn. 20030087051, the prior art is replete with myriad and diverse shipping containers for perishables.

While all of the aforementioned prior art constructions are adequate for the basic purpose and function for which they have been specifically designed, they are uniformly deficient with respect to their failure to provide a simple, efficient, and practical collapsible shipping container.

As a consequence of the foregoing situation, there has existed a longstanding need for a new and improved collapsible foam shipping container for perishables, and the provision of such a device is a stated object of the present invention.

BRIEF SUMMARY OF THE INVENTION

Briefly stated, the present invention provides a collapsible foam shipping cooler and a process for producing the collapsible cooler. The collapsible cooler includes a linear series of attached side panel sections where each of the adjacent side panel sections are separated by a V groove formed by 45° beveled cuts made in a ends of each of the sections, and an adhesive tape flexible hinge is attached on the side of the panels opposite the V groove. The series of attached side panel sections is movable between a collapsed storage mode and an assembled mode where the series of sections are arranged to form a closed rectangular loop with top and bottom perimeter edges. Top and bottom foam panels contact the top and bottom edges of the closed loop to form a closed insulated cooler which is matingly received in a conventional corrugated box shipping container.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with drawings, wherein.

DETAILED DESCRIPTION OF THE INVENTION

Figure 1:
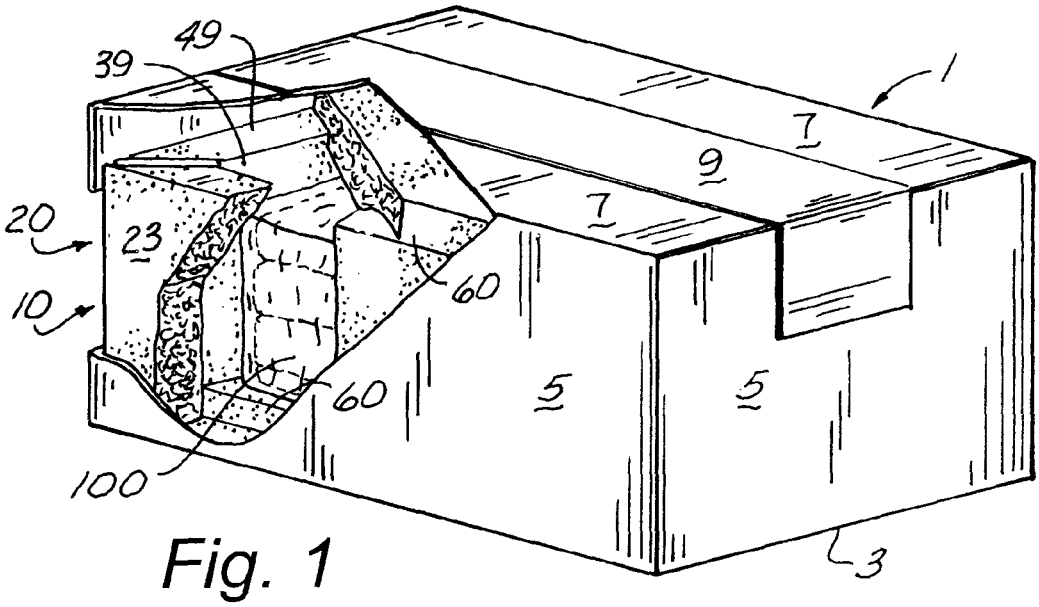
FIG. 1 is a perspective view of an insulated shipping container including the collapsible foam shipping cooler of the present invention, portions being cut away to show the components of the present invention.

As can be seen by reference to the drawings, and in particular to FIG. 1, the collapsible foam cooler that forms the basis of the present invention is designated generally by the reference to number 10. The collapsible container 10 is matingly received within a corrugated box exterior shipping container 1 having a bottom 3, sidewalls 5, and a closable top 7 sealed by a strip of shipping box tape 9. The collapsible foam cooler 10 encloses a perishable product 100 such a seafood or meat.

The collapsible cooler includes a linear series 20 of connected side panel sections 22, 24, 36, 28, and identical top end panels 60.

Figure 3:
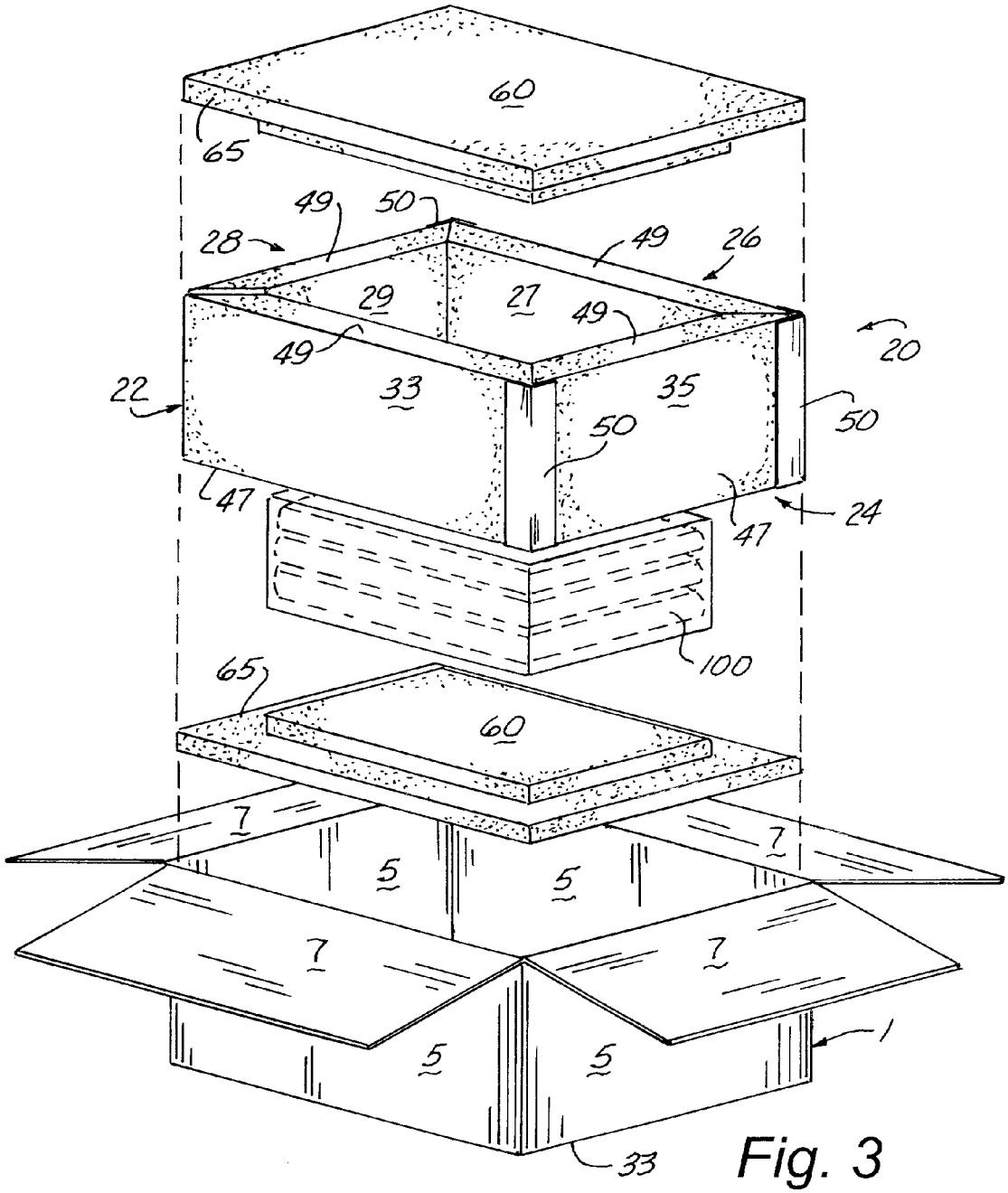
FIG. 3 is an exploded perspective view illustrating the relationship of the components of the present invention.
Figure 4:
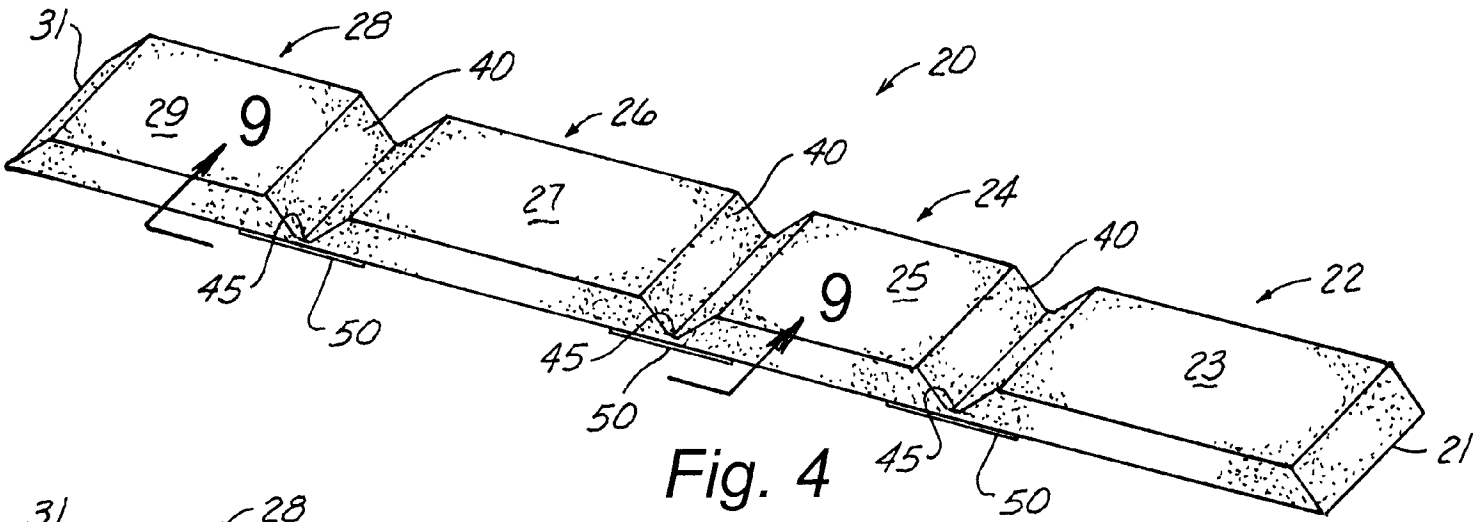
FIG. 4 is a perspective view of the interior side of a series of connected sidewall panels disposed in the flat collapsed mode showing the beveled edges of adjacent panels.
Figure 5:
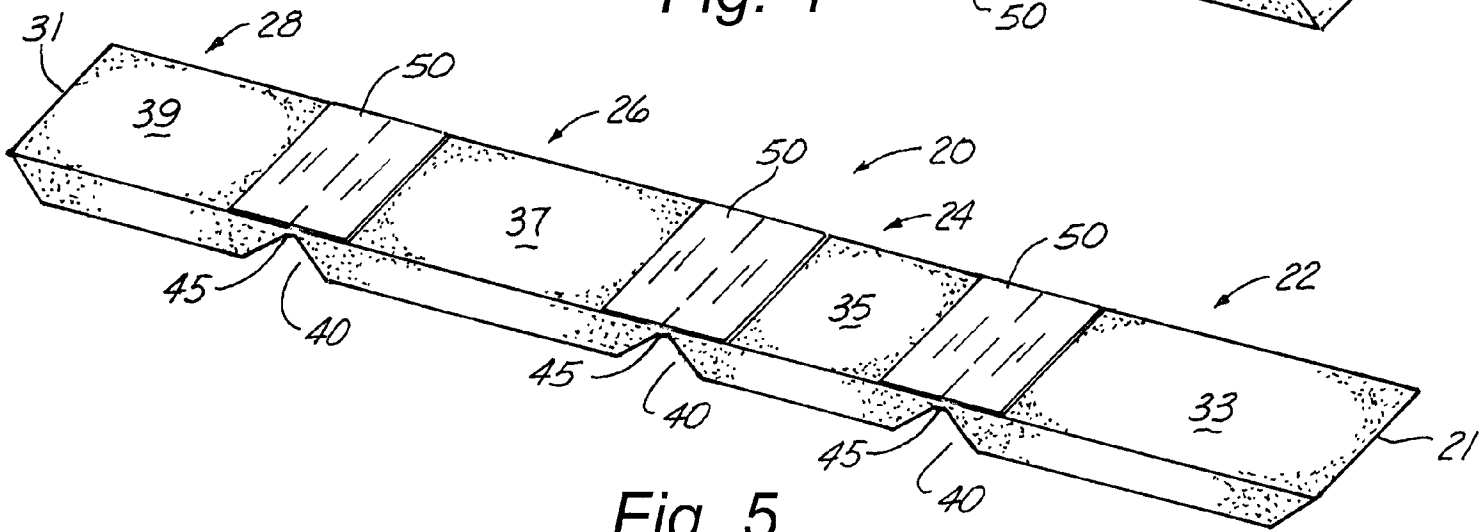
FIG. 5 is a perspective view of the exterior side of the series of sidewall panels in the flat collapsed mode, showing the flexible hinge tape applied on the exterior side of the beveled edges of adjacent panels.
Figure 9:
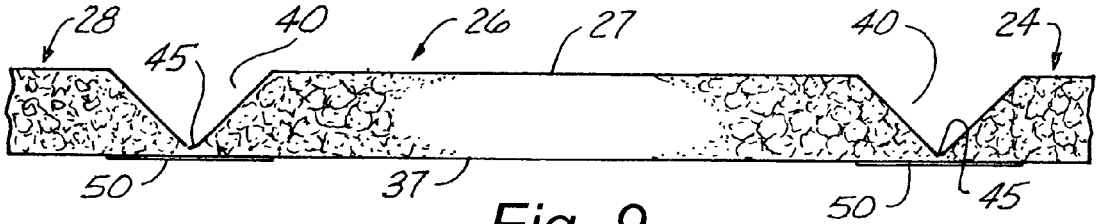
FIG. 9 is an enlarged sectional view taken along line 9-9 of FIG. 4.

The series 20 of panel sections 22, 24, 26, 28 has opposite free ends 21 and 31, and interior surfaces 23, 25, 27, 29 having 45° bevel cuts made therein to form V grooves 40 between each of the adjacent panel sections 22-24, 24-26 and 26-28, and beveled ends 21 and 31 (FIG. 4). An adhesive tape flexible hinge 50 is attached to the exterior surfaces 33, 35, 37, 39 of panel sections 22, 24, 26, 28 opposite the V grooves 40 (FIG. 5). A thin walled foam connector 45 connects each of the adjacent panel sections 22-24, 24-26 and 26-28 at the bottom of the V grooves 40 (FIG. 9). The series 20 of connected side panels 22, 24, 26, 28 is movable between a flat collapsed mode (FIGS. 5 and 6), and an assembled mode (FIGS. 1-3) wherein the adjacent panels 22-24, 24-26, 26-28 are at 90° angles with respect to each other to form a closed rectangular loop sidewall section with a bottom perimeter edge 47 and a top perimeter edge 49, and where the free ends 21, 31 are positioned adjacent to each other.

Figure 2:
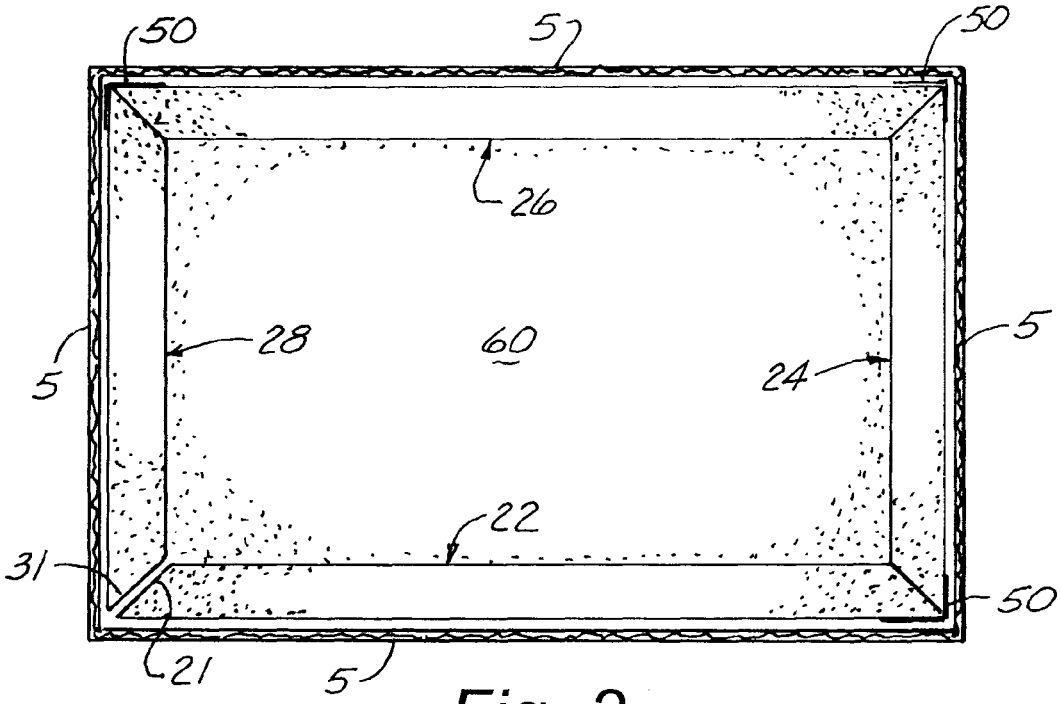
FIG. 2 is a sectional view of the shipping container of FIG. 1.

The top and bottom panels 60 shown in FIGS. 1-3 and 6 are recessed with a perimeter lip 65. The lip 65 of the bottom panel 60 contacts the bottom perimeter edge 47 of the closed loop sidewall section, and the lip 65 of the top panel 60 contacts the top perimeter edge 49 to form a closed foam shipping cooler 10 for perishables 100 (FIGS. 1-3).

Figure 6:
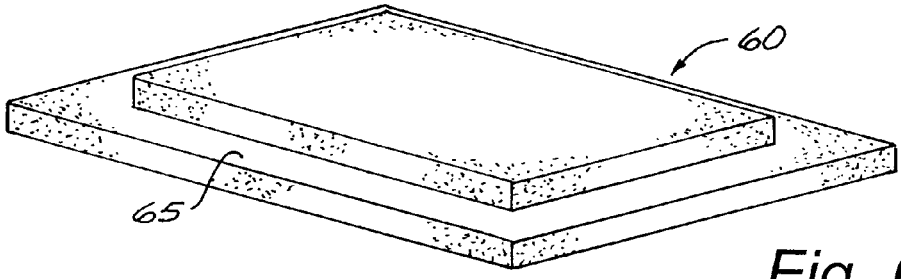
FIG. 6 is a perspective view of a recessed panel used for both the top and bottom panels of the collapsible cooler.
Figure 7:
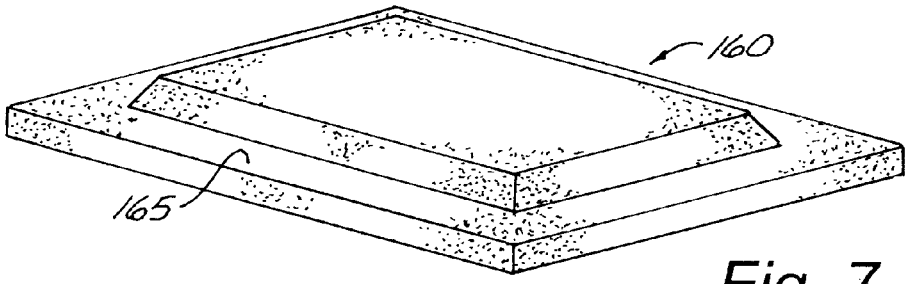
FIG. 7 is a perspective view of an alternate top and bottom beveled panel.
Figure 8:
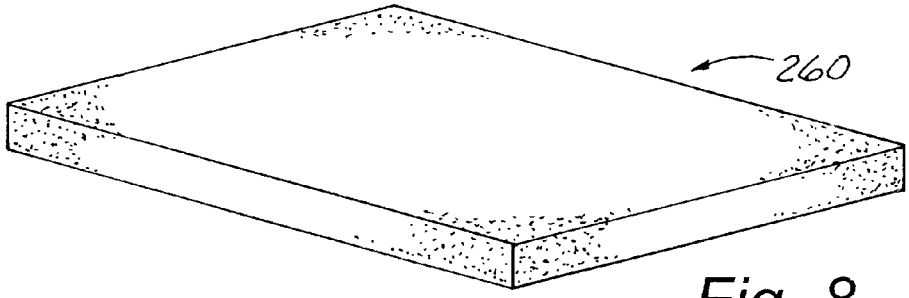
FIG. 8 is a perspective view of another alternate top and bottom flat panel.

In the preferred embodiment, the collapsible foam cooler 10 is formed from closed cell expanded polystyrene (EPS) foam. A block of EPS foam is first hot wire cut from a block of EPS to the desired sheet thickness while simultaneously cutting the V-grooves in the interior surface of the sheet leaving a thin wall of foam at the bottom of the V-grooves. The sheets are then either sent to a tape application machine or adhesive tape is applied manually to the exterior surface of the sheet opposite the V-grooves the entire width of the sheet. The sheets are then hot wire chopped on a line perpendicular to the V-groove to form a series of connected side panel sections in a collapsed mode. The top and bottom foam panels 60, as shown in FIG. 6, are formed from a sheet of EPS of the desired thickness by profile hot wire cutting the four sides to correspond to the dimensions of the series of connected side panel sections in the assembled rectangular mode. Alternate identical top and bottom foam beveled panels 160 with perimeter lips 165 (FIG. 7), and identical top and bottom flat panels 260 (FIG. 8) may also be formed by hot wire cutting, and used to form the closed foam shipping cooler 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A process for producing a collapsible foam shipping cooler for perishables, the process comprising the steps of:

providing a block of closed cell foam material;

cutting the block of foam to form a sheet having a desired thickness, an interior surface and an exterior surface;

cutting a series of linear grooves in the interior surface of the sheet, the grooves defining the juncture of adjacent foam panel sections;

the grooves extending partially through the thickness of the sheet and leaving a foam portion between the exterior surface and the groove, the foam portion being a flexible hinge at the juncture of adjacent foam panels;

cutting the sheet along a line perpendicular to the grooves to form a series of connected side panel sections in a collapsed mode, the series of connected side panel sections being movable between the collapsed mode and an assembled mode wherein adjacent panels of the series of panels are angularly disposed with respect to each other to form a closed loop sidewall section having a bottom perimeter edge and a top perimeter edge, wherein opposite ends of the series of adjacent panels are disposed adjacent to each other.

2. The process of claim 1, wherein the closed cell foam is an expandable polystyrene.

3. The process of claim 1, wherein the step of cutting the block of foam to form a sheet and the step of cutting grooves in the interior surface of the sheet are performed simultaneously.

4. The process of claim 3, wherein the cutting steps are performed using a hot wire cutting apparatus.

5. The process of claim 1, wherein the grooves are V grooves formed by cutting two adjacent 45° bevels.

6. The process of claim 5, wherein the series of connected side panel sections includes four side panels that form a rectangle in the assembled mode.

7. The process of claim 1, further including the step of providing a bottom foam panel disposed to contact the bottom perimeter edge and underlie the closed loop sidewall section, and wherein the bottom foam panel includes a recessed perimeter disposed to contact the bottom perimeter edge of the closed loop sidewall section.

8. The process of claim 7, wherein the bottom foam panel includes a beveled perimeter disposed to contact the bottom perimeter edge of the closed loop sidewall sections.

9. The process of claim 7, wherein the bottom foam panel includes a flat perimeter disposed to contact the bottom perimeter edge of the closed loop sidewall section.

10. The process of claim 7, further including the steps of:

providing an assembled exterior shipping container having a bottom, sidewalls and a closable top;

placing the bottom foam panel in the exterior shipping container to rest on the container bottom;

placing the closed loop sidewall section in the exterior shipping container wherein the bottom perimeter edge contacts the bottom foam panel, and the exterior surface of the closed loop sidewall section is disposed adjacent the sidewalls of the exterior shipping container;

placing a quantity of perishable product to contact the bottom foam panel;

closing the closable top of the exterior shipping container.

11. The process of claim 10, further including the steps of:

providing a top foam panel disposed to contact the top perimeter edge and overlie the closed loop sidewall section, and placing the top foam panel in the exterior shipping container to contact the top perimeter edge of the closed loop sidewall section.

12. The process of claim 1, further including the step of providing a top foam panel disposed to contact the top perimeter edge and overlie the closed loop sidewall section, and wherein the top foam panel includes a recessed perimeter disposed to contact the top perimeter edge of the closed loop sidewall section.

13. The process of claim 12 wherein the top foam panel includes a beveled perimeter disposed to contact the top perimeter edge of the closed loop sidewall section.

14. The process of claim 12, wherein the top foam panel includes a flat perimeter disposed to contact the top perimeter edge of the closed loop sidewall section.

15. A collapsible foam shipping container for perishables made by the process of claim 1.

16. A collapsible foam shipping container for perishables, comprising:

a linear series of four connected closed cell expanded polystyrene foam side panel sections having opposite free ends, each of the series of side panel sections having an interior surface, an exterior surface, a thickness, ends, bevel cuts through the interior surface at the ends forming a groove between adjacent side panels of the series, the grooves extending partially through the thickness of the series of side panels and leaving a portion of foam material disposed between the exterior surface and the groove defining a foam connection between the adjacent side panels, the series of side panel sections being movable between a collapsed mode and an assembled mode wherein adjacent panels are disposed at angles with respect to each other to form a closed loop sidewall section having a bottom perimeter edge and a top perimeter edge, and the opposite free ends are disposed adjacent to each other;

a strip of adhesive tape located on the exterior surface opposite each groove;

a bottom foam panel disposed to contact the bottom perimeter edge and underlie the closed loop sidewall section; and a top foam panel disposed to contact the top perimeter edge and overlie the closed loop sidewall section.

17. The collapsible foam shipping container of claim 16, wherein the bevel cuts are at 45° forming a V groove, and wherein the adjacent side panels are disposed at 90° angles to form a closed rectangular loop.

* * * * *